US005871410A

United States Patent [19]

Simo et al.

[11] Patent Number: 5,871,410

[45] Date of Patent: Feb. 16, 1999

[54] FERRULE WITH IRREGULAR SKIN SURFACE FOR AN ARCHERY BROADHEAD

[75] Inventors: Miroslav A. Simo, Riverside; Robert S. Mizek; Frank A. Harwath, both of Downers Grove, all of Ill.

[73] Assignee: New Archery Products Corp., Forest Park, Ill.

[21] Appl. No.: 989,562

[22] Filed: Dec. 12, 1997

[51] Int. Cl.[6] ..... F42B 6/08

[52] U.S. Cl. ..... 473/883

[58] Field of Search ..... 473/578, 582, 473/583, 216, 219, 221

[56] References Cited

U.S. PATENT DOCUMENTS

| | | | |
|---|---|---|---|
| 4,529,208 | 7/1985 | Simo . | |
| 4,676,512 | 6/1987 | Simo . | |
| 4,846,481 | 7/1989 | Wageman | 473/578 |
| 5,114,156 | 5/1992 | Saunders | 473/582 |
| 5,562,291 | 10/1996 | Garcia | 473/582 |

FOREIGN PATENT DOCUMENTS

| | | | |
|---|---|---|---|
| 2014463 | 8/1979 | United Kingdom | 473/216 |
| 2039755 | 8/1980 | United Kingdom | 473/216 |

*Primary Examiner*—John A. Ricci

*Attorney, Agent, or Firm*—Speckman Pauley Petersen & Fejer

[57] ABSTRACT

An archery broadhead having a ferrule body with longitudinal grooves that accept a plurality of fixed and/or pivotal blades. At least a port ion of the ferrule body has a multiplicity of irregularities that form an irregular skin surface having a surface roughness. The irregularities enhance aerodynamic flight characteristics of the broadhead and also reduce frictional drag as the broadhead penetrates a target. The irregularities can be formed by a directional, non-directional or multi-directional set of repeating dimples, grooves, lands, stippling and/or any other suitable structure that forms a pattern, uniform or non-uniform.

26 Claims, 6 Drawing Sheets

FERRULE WITH IRREGULAR SKIN SURFACE FOR AN ARCHERY BROADHEAD

BACKGROUND OF THE INVENTION

1. Field of the Invention

This invention relates to a ferrule of an archery broadhead which has a plurality, preferably but not necessarily a multiplicity, of irregularities which form an irregular skin surface that produces enhanced aerodynamic flight characteristics and that reduces frictional drag as the ferrule penetrates a target.

2. Description of Prior Art

Conventional archery broadheads have ferrules with various cross sections, taken in a direction perpendicular to a longitudinal axis of the ferrule. Ferrules of relatively older broadheads have a generally circular cross section, ignoring blade slots in the ferrule, whereas ferrules of relatively newer broadheads have a generally non-circular cross section, ignoring blade slots in the ferrule. For example, Simo, U.S. Pat. No. 4,529,208 and Simo, U.S. Pat. No. 4,676,512 teach broadheads having ferrules with such non-circular cross sections.

Some conventional broadheads have blood grooves which are relatively deep grooves that extend along a longitudinal direction of the ferrule.

There exists an apparent need for a broadhead that has a ferrule with a repeating pattern of surface irregularities that both enhance aerodynamic flight characteristics and reduced frictional drag upon target penetration.

SUMMARY OF THE INVENTION

It is one object of this invention to provide an improved ferrule, for an archery broadhead, which has a plurality of irregularities that form an irregular skin surface.

It is another object of this invention to provide a ferrule that has a non-circular cross section, when taken in a direction perpendicular to a longitudinal axis of the ferrule and that has a plurality of irregularities that form an irregular skin surface.

The above and other objects of this invention are accomplished with an archery broadhead that has a ferrule body with a plurality of generally longitudinal blade slots that each accommodate a blade, fixed or pivotal with respect to the ferrule body. Between the blade slots, at least a portion and preferably all of the ferrule body has a plurality of surface irregularities that form an irregular skin surface. During flight of a broadhead, the irregular skin surface of the ferrule body interrupts and/or causes turbulence within or near a boundary layer of fluid flow that passes over the ferrule body, and thereby improves aerodynamic flight characteristics. During target penetration, the irregularities forming the irregular skin surface also reduce the surface area of contact between the ferrule body and the target material, and thereby reduces frictional drag, when compared to broadheads that have no or very few surface irregularities.

In one preferred embodiment of this invention, the irregularities are positioned on a segment of the ferrule body which diverges in a direction from a leading portion to a trailing portion of the ferrule body. In different preferred embodiments of this invention, the irregularities may include any one or combination of: adjacent lands and grooves preferably but not necessarily oriented in a longitudinal direction; dimples formed by a raised surface and/or an indented surface; and/or any other surface irregularity directly or indirectly resulting from a manufacturing process.

Although this specification focuses upon irregularities within a ferrule body of a broadhead, it is apparent that other portions of the ferrule body, a blade or any other component of the broadhead may also have irregularities that form an irregular skin surface. For example, even a blade or an arrow shaft may have an irregular skin surface to enhance aerodynamic flight characteristics and to reduce frictional drag when any portion or all of the blade or the arrow shaft penetrates the target.

DETAILED DESCRIPTION OF THE DRAWINGS

The above and other features of this invention become more apparent when taken in view of the drawings, wherein.

DESCRIPTION OF PREFERRED EMBODIMENTS

Figure 1:
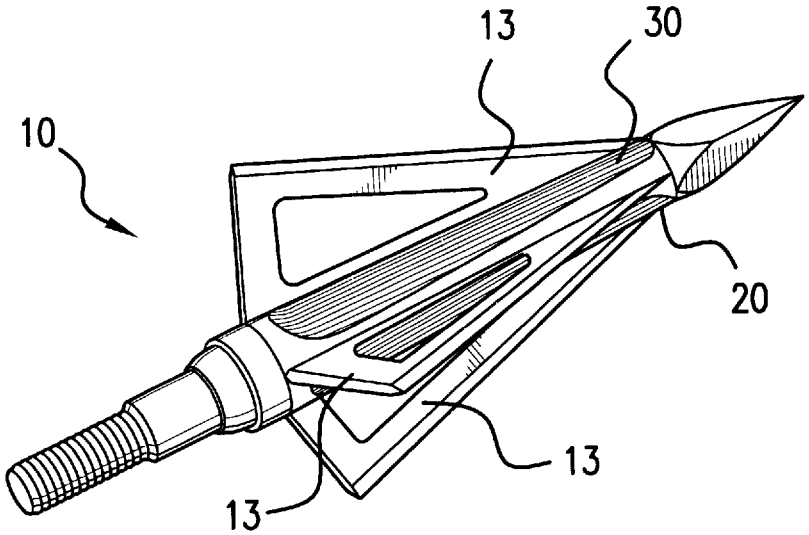
FIG. 1 is a perspective view of an archery broadhead with three blades mounted within blade slots of a ferrule body wherein the ferrule body has a non-circular cross section and an irregular skin surface, according to one preferred embodiment of this invention.

Referring to FIG. 1, archery broadhead 10 comprises ferrule body 20 which either can have a shape as shown in FIGS. 1–5 or can have any other suitable shape similar to a shape of any conventional broadhead or that provides acceptable aerodynamic flight characteristics. Broadhead 10 has a plurality of longitudinal grooves 12 that each accept or accommodate a blade 13. Although broadhead 10 preferably comprises three or four blades 13, it is apparent that broadhead 10 may comprise more or less blades 13. Each blade 13 can have any one of suitable shapes known or apparent to those skilled in the art of broadhead designs.

Figure 2:
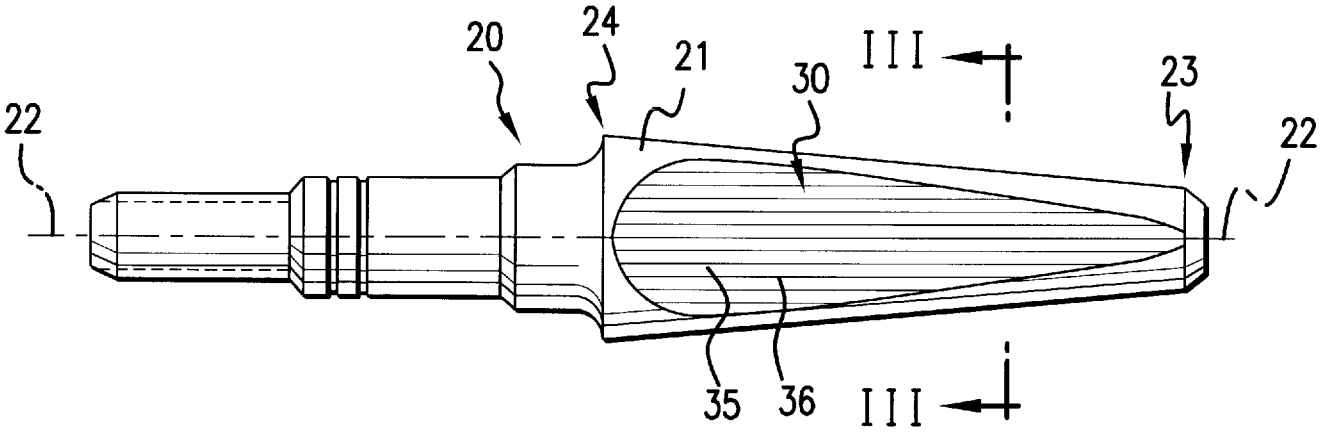
FIG. 2 is a side view of a ferrule body, according to one preferred embodiment of this invention.
Figure 3:
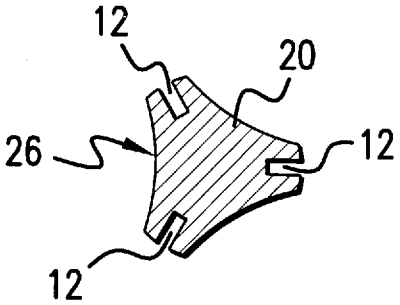
FIG. 3 is a cross-sectional view of the ferrule body as shown in FIG. 2, taken along line III—III, as shown in FIG. 2.
Figure 4:
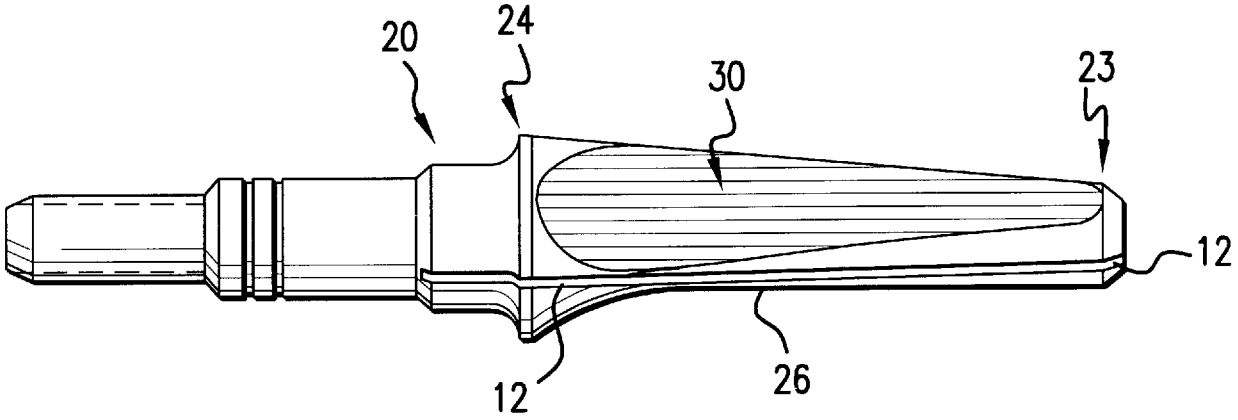
FIG. 4 is a side view of the ferrule body shown in FIG. 3 but rotated approximately 45° about a longitudinal axis from the position shown in FIG. 3, to show the longitudinal blade slot and a scallop area or scallop section of the ferrule body.
Figure 5:
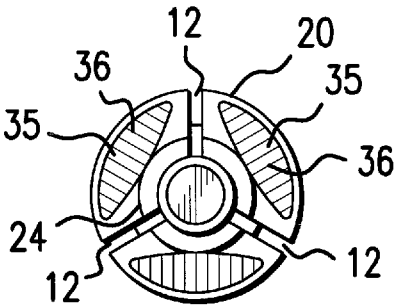
FIG. 5 is a front view of the ferrule body as shown in FIG. 4.

At least a portion of a segment of ferrule body 20 between two adjacent blades 13 has a plurality of surface irregularities that form irregular skin surface 30, such as shown in FIGS. 1, 2 and 4. Each segment 21 of ferrule body 20 between two adjacent blades 13 preferably has a multiplicity of irregularities. In certain embodiments of this invention, an overall pattern of the irregularities repeat in a generally consistent fashion with respect to dimensions and shapes. Throughout this specification and if in the claims, the term consistently repeating is intended to relate to a general pattern of the irregularities repeating over a given surface area of irregular skin surface 30.

The irregularities are intended to form a particular roughness of irregular skin surface 30 of ferrule body 20. The term roughness refers to a relatively finely spaced surface-texture, for example which can be a product of a particular manufacturing process or which can result from a cutting action of tools or abrasive grains. The term waviness refers to secondary irregularities upon which surface roughness is superimposed, which have a significantly longer wavelength than irregularities associated with surface roughness. In contrast to roughness, waviness is often the product of machine or work deflection, heat treatment or warping. Waviness is usually measured as a maximum peak-to-valley distance and is also measured by first filtering out the roughness of a skin surface. The term lay refers to a direction of a predominant visible surface roughness pattern. The term flaws refers to surface imperfections that occur at relatively infrequent intervals. Flaws are normally caused by nonuniformity of the material or are the result of damage to the surface subsequent to processing. Flaws typically include scratches, dents, pits and/or cracks, and should not be considered as irregularities that form surface roughness. Roughness formed by irregularities as used in this specification and in the claims is intended to relate to a surface quality which is a product of a process and should not be confused or interchangeable with surface flaws.

Figure 7:
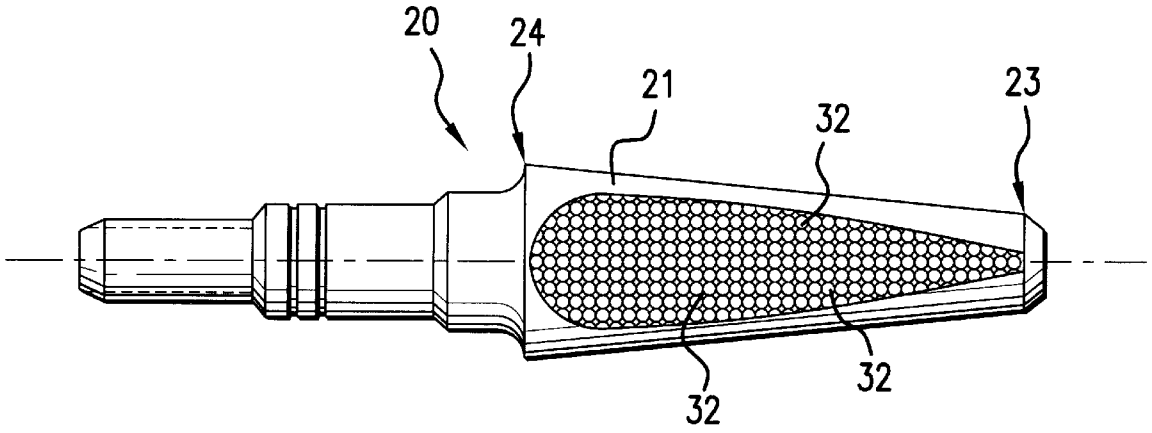
FIG. 7 is a side view of a ferrule body with dimples forming an irregular surface, according to one preferred embodiment of this invention.
Figure 8:
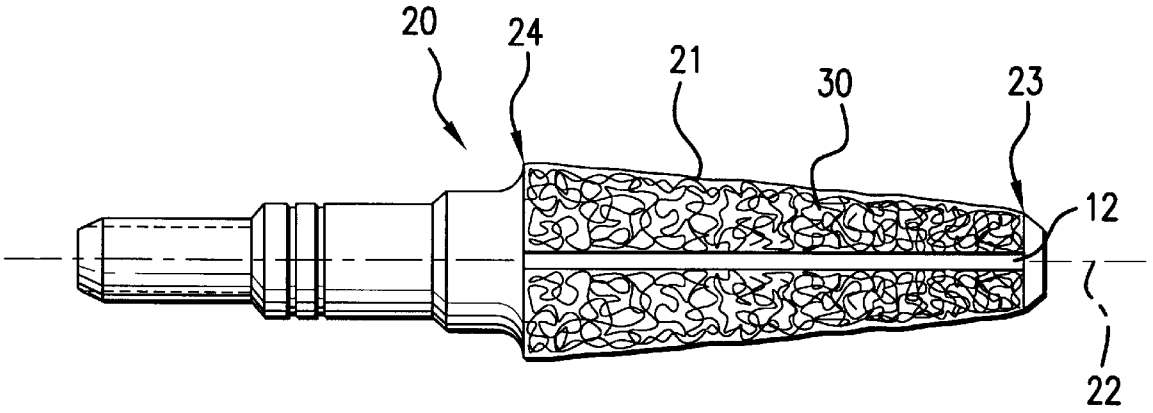
FIG. 8 is a side view of a ferrule body with a multidirectional pattern of irregularities forming an irregular skin surface, according to another preferred embodiment of this invention.

In one preferred embodiment according to this invention, only a portion of ferrule body 20 comprises irregularities. For example, as shown in FIGS. 2, 4 and 7, segment 21 of ferrule body 20, which preferably extends in longitudinal direction 22 from leading portion 23 to trailing portion 24, between two adjacent blades 13 is partially covered with irregularities. In another preferred embodiment according to this invention, segment 21, such as shown in FIG. 8, is completely covered with irregularities. The degree to which segment 21 is covered with irregularities may be a function of various design factors, such as the type or shape of irregularities, the material, the desired roughness factor and/or the desired aerodynamic effect upon the flight characteristics of broadhead 10.

Figure 6:
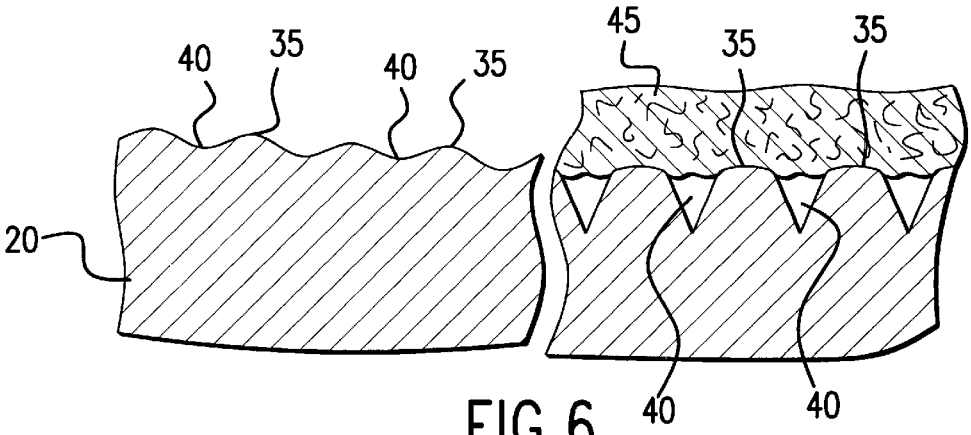
FIG. 6 is an enlarged partial sectional view of an irregular skin surface of a ferrule body, showing lands with rounded apex sections, according to two preferred embodiments of this invention.

In one preferred embodiment of this invention, the irregularities comprise a multiplicity of dimples 32, as shown in FIG. 7. Dimples 32 can be formed by either a raised surface or an indented surface. In another preferred embodiment of this invention, the irregularities are formed by a process, such as but not limited to machine cutting, injection molding, and/or chemical etchings, that produces pits, protuberants, pores, stippling and/or particulates that form a non-directional pattern. In still another preferred embodiment of this invention, the irregularities are formed by a process that produces a surface roughness with a multidirectional pattern, such as shown in FIG. 8. It is also possible to form the irregularities with epoxy, paint or any other suitable material or process which can be used to produce the irregularities. Regardless of the manner in which the irregularities are produced or otherwise achieved, one intended result is for the irregularities to break-up, interrupt or cause turbulence within or near a boundary layer of fluid flow passing over ferrule body 20, such as when broadhead 10 is in flight. Another intended result is for the apex of each irregularity to be designed in shape and size so that upon target penetration, as shown in FIG. 6, the target material 45 contacts only the apex or upper portion of the surface irregularity and does not contact ferrule body 20 within grooves 40 which are between the apexes of lands 35. It is apparent that tests can be conducted with different target materials 45, including synthetic materials or various animal hides, fleshes and/or bones to determine which shape and size of irregularities most effectively reduce frictional drag upon target penetration.

Figure 6A:
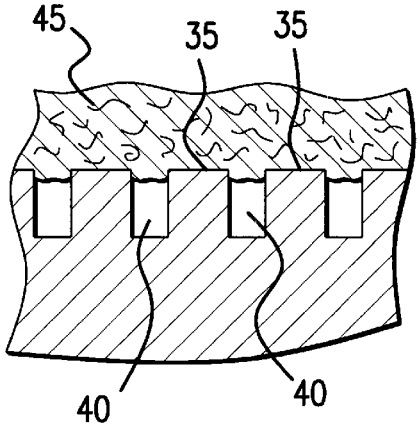
FIG. 6A is an enlarged partial sectional view of an irregular skin surface of a ferrule body showing lands with squared or flat apex sections, according to another preferred embodiment of this invention.
Figure 6B:
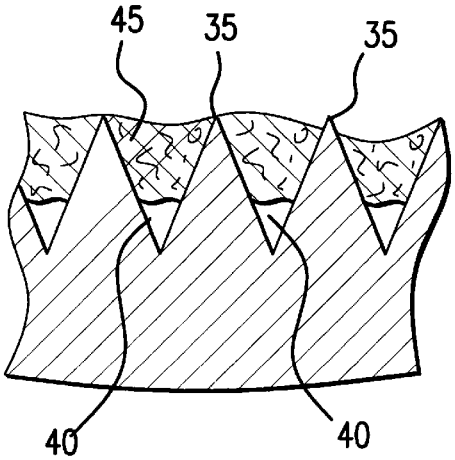
FIG. 6B is an enlarged partial sectional view of an irregular skin surface of a ferrule body showing lands with pointed apex sections, according to another preferred embodiment of this invention.
Figure 8A:
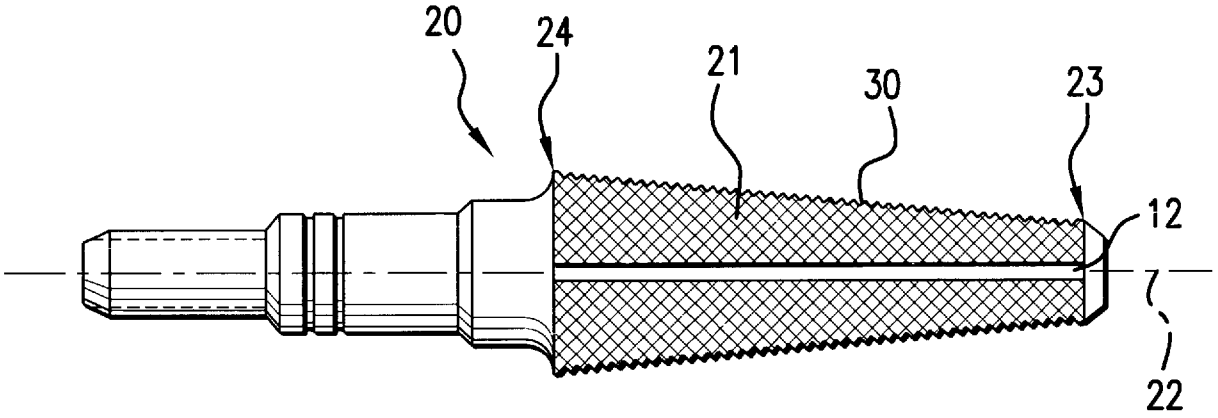
FIG. 8A is a side view of a ferrule body with a crisscross pattern of irregularities forming an irregular skin surface, according to yet another preferred embodiment of this invention.

In one preferred embodiment of this invention, the irregularities comprise a plurality of adjacent lands 35 and grooves 40, as shown in FIGS. 1, 2, 4 and 6. Lands 35 and grooves 40 are positioned either generally parallel to each other, as shown in FIG. 2, or are positioned at an angle with respect to each other. For example, as shown in FIG. 8A, lands 35 and grooves 40 may crisscross each other. Lands 35 and/or grooves 40 can have a pointed as shown in FIG. 6B, truncated, rounded as shown in FIG. 6, squared as shown in FIG. 6A, or any other suitably shaped apex. In one preferred embodiment of this invention, a ratio of spacing between two adjacent grooves 40 to a depth of each of the two adjacent grooves 40 is about 4:1. However, any other suitable ratio can be used, depending upon the desired aerodynamic flight characteristics and/or the desired frictional drag.

In one embodiment where lands 35 and grooves 40 are positioned generally parallel to longitudinal direction 22, there will be a minimal steering effect during flight of broadhead 10. As a direction of lands 35 and grooves 40 become further askew from longitudinal direction 22, lands 35 and grooves 40 may have a greater steering effect during flight of broadhead 10; for example askewed lands 35 and grooves 40 may cause broadhead 10 to rotate about a central longitudinal axis of ferrule body 20.

The irregularities may be formed on ferrule body 20 which has either a circular or a non-circular cross section, when taken in a direction generally perpendicular to longitudinal direction 22. As used throughout this specification and in the claims, the phrase follows a path of an arc segment of a circle is intended to relate to ferrule body 20 having a circular cross section, when ignoring the voids formed by longitudinal grooves 12. As used throughout this specification and in the claims, the phrase follows a path which differs from an arc segment of a circle is intended to relate to ferrule body 20 having a non-circular cross section, when ignoring the voids fonned by longitudinal grooves 12. For example, such non-circular cross section can be formed by ferrule body 20 having scallop 26, as shown in FIGS. 2–5. If the cross section is non-circular, the area of the cross section is preferably but not necessarily less than an area of a circular cross section with the same diameter as a largest diameter of the non-circular cross section, again ignoring the voids formed by longitudinal grooves 12.

According to this invention, the irregularities that form irregular skin surface 30 form an overall surface area that is greater than the overall surface area of an otherwise smooth surface of ferrule body 20. In one preferred embodiment of this invention, the overall surface area corresponding to the irregularities is in a range of about 5% to about 40% greater than an overall surface area corresponding to an otherwise smooth surface of ferrule body 20. In one preferred embodiment according to this invention, a roughness height rating of irregularities of ferrule body 20 is in a range of about 150 micro inches to about 4000 micro inches, and preferably greater than about 250 micro inches.

It is apparent that different elements can be exchanged between preferred embodiments discussed in this specification and shown in FIGS. 1–8. It is also apparent that blade 13 can be fixedly or pivotally mounted with respect to ferrule body 20.

While in the foregoing specification this invention has been described in relation to certain preferred embodiments thereof, and many details have been set forth for purpose of illustration, it will be apparent to those skilled in the art that the invention is susceptible to additional embodiments and that certain of the details described can be varied considerably without departing from the basic principles of the invention.

What is claimed is:

1. In an archery broadhead having a ferrule body with a plurality of generally longitudinal grooves that each accept a blade, the improvement comprising:

at least a portion of a segment of the ferrule body between the blade-accepting grooves having a plurality of irregularities forming an irregular skin surface.

2. In an archery broadhead according to claim 1 wherein said portion of said segment extends diverges in a longitudinal direction from a leading portion to a trailing portion of the archery broadhead.

3. In an archery broadhead according to claim 1 wherein said at least a portion of said segment has a multiplicity of said irregularities.

4. In an archery broadhead according to claim 3 wherein said irregularities each comprise a dimple.

5. In an archery broadhead according to claim 4 wherein each dimple is formed by a raised surface.

6. In an archery broadhead according to claim 4 wherein each dimple is formed by an indented surface.

7. In an archery broadhead according to claim 1 wherein said irregularities comprise a plurality of adjacent lands and grooves.

8. In an archery broadhead according to claim 7 wherein said lands and said grooves are generally linear.

9. In an archery broadhead according to claim 8 wherein said lands and said grooves are positioned generally parallel to a longitudinal axis of the ferrule.

10. In an archery broadhead according to claim 7 wherein said lands and said grooves crisscross each other.

11. In an archery broadhead according to claim 7 wherein said lands each have a flat apex.

12. In an archery broadhead according to claim 7 wherein said lands each have a rounded apex.

13. In an archery broadhead according to claim 7 wherein said lands each have a pointed apex.

14. In an archery broadhead according to claim 7 wherein a ratio of spacing between two adjacent grooves of said grooves to a depth of said grooves is about 4:1.

15. In an archery broadhead according to claim 1 wherein along a cross section taken between the blade-accepting grooves and in a normal direction which is perpendicular to a longitudinal axis of the ferrule, said irregular skin surface generally follows an arc segment of a circle.

16. In an archery broadhead according to claim 1 wherein along a cross section taken between the blade-accepting grooves and in a normal direction which is perpendicular to a longitudinal axis of the ferrule, said irregular skin surface generally follows a path which differs from an arc segment of a circle.

17. In an archery broadhead according to claim 1 wherein the irregularities have a roughness height rating greater than about 250 micro inches.

18. In an archery broadhead according to claim 1 wherein the irregularities are arranged in a uniform pattern.

19. In an archery broadhead according to claim 1 wherein the irregularities are arranged in a non-uniform pattern.

20. In an archery broadhead having a ferrule body with a plurality of generally longitudinal grooves that each accept a blade, wherein a skin surface of the ferrule body would otherwise have a first surface area corresponding to a smooth surface, the improvement comprising:

at least a portion of a segment of the ferrule body between the blade-accepting grooves having a roughened surface relative to the smooth surface wherein a second surface area of said roughened surface is greater than the first surface area.

21. In an archery broadhead according to claim 20 wherein said second surface area is in a range of about 5% to about 40% greater than the first surface area.

22. In an archery broadhead according to claim 20 wherein along a cross section taken between the blade-accepting grooves and in a normal direction which is perpendicular to a longitudinal axis of the ferrule, said irregular skin surface generally follows an arc segment of a circle.

23. In an archery broadhead according to claim 20 wherein along a cross section taken between the blade-accepting grooves and in a normal direction which is perpendicular to a longitudinal axis of the ferrule, said irregular skin surface generally follows a path which differs from an arc segment of a circle.

24. In an archery broadhead having a ferrule body with a plurality of generally longitudinal grooves that each accept a blade and the ferrule body having at least one scalloped section between the blades, the improvement comprising:

a skin surface of the at least one scalloped section having a roughness height rating in a range from about 150 micro inches to about 4000 micro inches.

25. In an archery broadhead according to claim 24 wherein along a cross section taken between the blade-accepting grooves and in a normal direction which is perpendicular to a longitudinal axis of the ferrule, said irregular skin surface generally follows an arc segment of a circle.

26. In an archery broadhead according to claim 24 wherein along a cross section taken between the blade-accepting grooves and in a normal direction which is perpendicular to a longitudinal axis of the ferrule, said irregular skin surface generally follows a path which differs from an arc segment of a circle.

* * * * *